US011384977B2

(12) United States Patent
Jung et al.

(10) Patent No.: US 11,384,977 B2
(45) **Date of Patent: *Jul. 12, 2022**

(54) REFRIGERATOR COMPRISING VACUUM SPACE

(71) Applicant: LG Electronics Inc., Seoul (KR)

(72) Inventors: Wonyeong Jung, Gyeongnam (KR); Myungryul Lee, Gyeongnam (KR); Sung Jhee, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 256 days.

This patent is subject to a terminal disclaimer.

(21) Appl. No.: 16/453,441

(22) Filed: Jun. 26, 2019

(65) Prior Publication Data

US 2019/0316831 A1 Oct. 17, 2019

Related U.S. Application Data

(63) Continuation of application No. 15/485,365, filed on Apr. 12, 2017, now Pat. No. 10,337,788, which is a (Continued)

(30) Foreign Application Priority Data

Oct. 28, 2010 (KR) ..... 10-2010-0105895

(51) Int. Cl.
*F25D 23/06* (2006.01)
*F25D 11/00* (2006.01)
*F25D 23/02* (2006.01)

(52) U.S. Cl.
CPC ..... *F25D 23/062* (2013.01); *F25D 11/00* (2013.01); *F25D 23/02* (2013.01); *F25D 23/066* (2013.01);
(Continued)

(58) Field of Classification Search
CPC ..... F25D 23/062; F25D 23/067; F25D 11/00; F25D 23/02; F25D 23/066; F25D 2201/14
(Continued)

(56) References Cited

U.S. PATENT DOCUMENTS 1,588,707 A 6/1926 Alexander
1,814,114 A 7/1931 Light
(Continued)

FOREIGN PATENT DOCUMENTS

CN 2062427 9/1990
CN 2275051 2/1998
(Continued)

OTHER PUBLICATIONS

European Office Action in European Application No. 19 172 995.3, dated Jul. 22, 2020, 5 pages.
(Continued)

*Primary Examiner* — Steve S Tanenbaum
(74) *Attorney, Agent, or Firm* — Fish & Richardson P.C.

(57) ABSTRACT

This invention relates to refrigerators, and more particularly to a refrigerator in which a vacuum space is formed between an outer case and an inner case of a body thereof for enhancing a heat insulating function. The refrigerator includes a body having a storage space for storing a predetermined storage object, wherein the body includes an inner case having the storage space, an outer case having an inside surface spaced a predetermined gap from an outside surface of the inner case to house the inner case, and a vacuum space provided between the inner case and the outer case sealed to maintain a vacuum state for heat insulating between the inner case and the outer case.

27 Claims, 17 Drawing Sheets

Related U.S. Application Data continuation of application No. 14/532,144, filed on Nov. 4, 2014, now Pat. No. 9,651,292, which is a continuation of application No. 13/241,725, filed on Sep. 23, 2011, now Pat. No. 8,899,068.

(52) U.S. Cl.
CPC ..... *F25D 23/067* (2013.01); *F25D 2201/14* (2013.01)

(58) Field of Classification Search
USPC ..... 62/440
See application file for complete search history.

(56) References Cited

U.S. PATENT DOCUMENTS

| | | | | |
|---|---|---|---|---|
| 1,845,353 | A | 2/1932 | Snell | |
| 1,984,261 | A * | 12/1934 | Foy | F25D 23/062 220/592.27 |
| 2,000,882 | A | 5/1935 | Comstock | |
| 3,813,137 | A | 5/1974 | Fellwock | |
| 3,936,553 | A | 2/1976 | Rowe | |
| 3,940,195 | A | 2/1976 | Tillman | |
| 4,444,821 | A | 4/1984 | Young et al. | |
| 5,175,975 | A | 1/1993 | Benson et al. | |
| 6,257,684 | B1 | 7/2001 | Hirath et al. | |
| 6,393,798 | B1 | 5/2002 | Hirath et al. | |
| 2002/0100250 | A1 | 8/2002 | Hirath | |
| 2003/0006025 | A1 | 1/2003 | Manini et al. | |
| 2004/0226956 | A1* | 11/2004 | Brooks | F25D 3/10 220/592.02 |
| 2005/0200252 | A1 | 9/2005 | Muller et al. | |
| 2010/0251653 | A1 | 10/2010 | Mills | |

FOREIGN PATENT DOCUMENTS

| | | |
|---|---|---|
| CN | 1464266 | 12/2003 |
| CN | 1635319 | 7/2005 |
| CN | 2711092 | 7/2005 |
| CN | 1987305 | 6/2007 |
| DE | 4325399 | 2/1995 |
| DE | 19648305 | 5/1998 |
| EP | 0071090 | 2/1983 |
| EP | 1533430 | 5/2005 |
| EP | 2133643 | 12/2009 |
| FR | 841436 | 5/1939 |
| JP | 10-281635 | 10/1998 |
| JP | H10281635 | 10/1998 |
| JP | 2002-071088 | 3/2002 |
| JP | 2002-267343 | 9/2002 |
| JP | 2007017053 | 1/2007 |
| KR | 2006085549 | 7/2006 |
| KR | 10-0725834 | 5/2007 |
| KR | 20100012750 | 2/2010 |
| RU | 2221972 | 1/2004 |
| RU | 2221973 | 1/2004 |
| RU | 2253792 | 6/2005 |
| WO | 2000/049352 | 8/2000 |
| WO | 2001/060598 | 8/2001 |
| WO | 2003/081152 | 10/2003 |

OTHER PUBLICATIONS

Korean Notice of Allowance in Korean Application No. 10-2019-0162954, dated Sep. 24, 2020, 7 pages (with English translation).
Extended European Search Report in European Application No. 19172995.3, dated Aug. 21, 2019, 7 pages.
Australian Examination Report dated Oct. 17, 2012, for Application No. 2011232782, in English, 4 pages.
Canadian Office Action dated Oct. 2, 2013 for Application No. 2,755,185, 3 pages.
Chinese Office Action dated Sep. 9, 2013 for Application. No. 201110332207.5, with English Translation, 27 pages.
European Search Report dated Jan. 8, 2014 for Application No. 11008030.6, 7 pages.
Russian Decision on Grant dated Jan. 21, 2013 for Application No. 2011143517, with English Translation, 13 pages.
Russian Office Action dated Oct. 23, 2012, for Application No. 2011143517, with English Translation, 7 pages.
Chinese Office Action dated Apr. 5, 2016 for Application No. 201410654449.X, with English translation, 9 pages.

* cited by examiner

【FIG. 1】
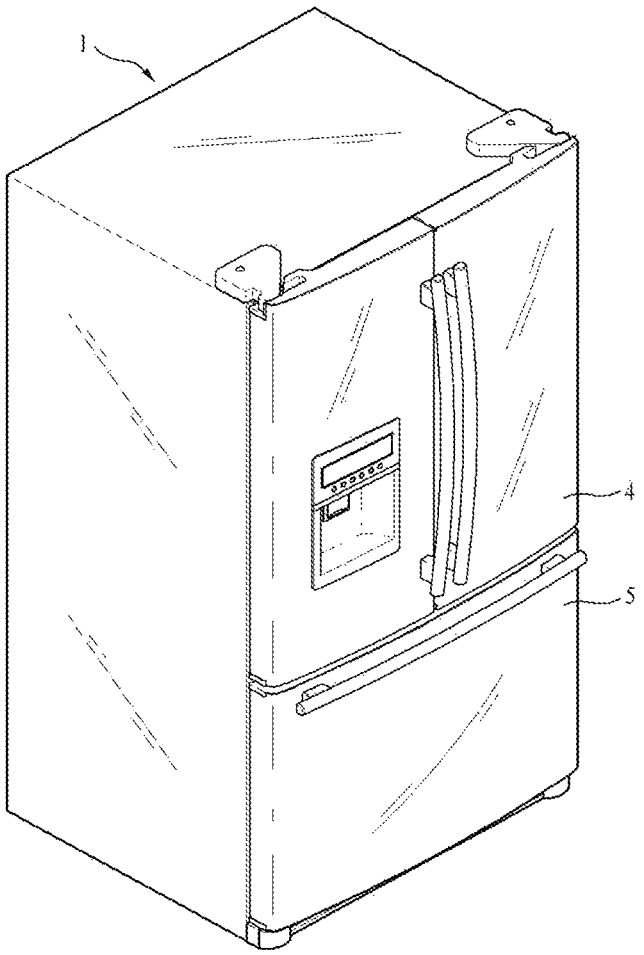

【FIG. 2】
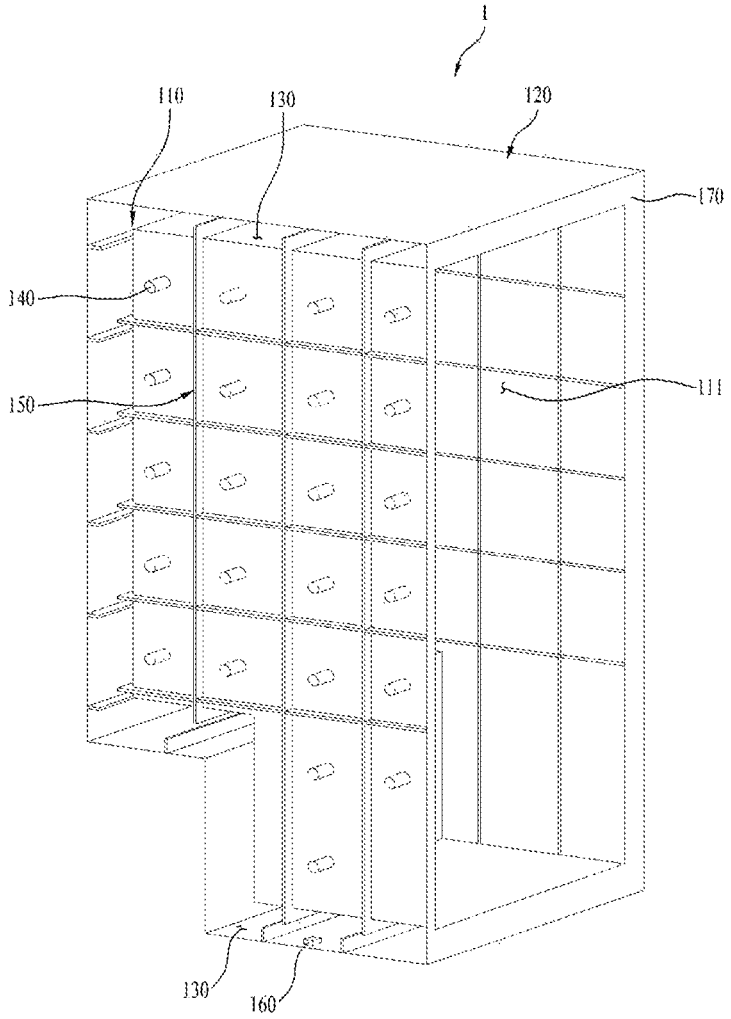

【FIG. 3 A】
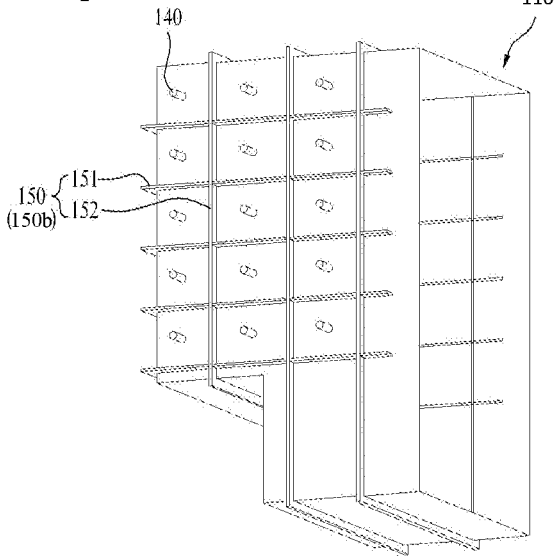
【FIG. 3 B】
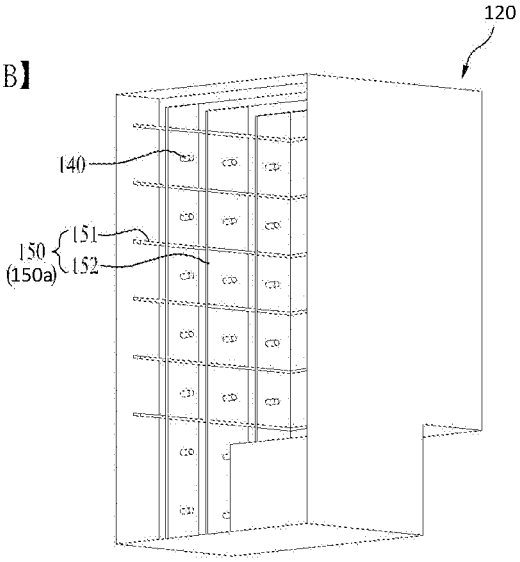

【FIG. 4】
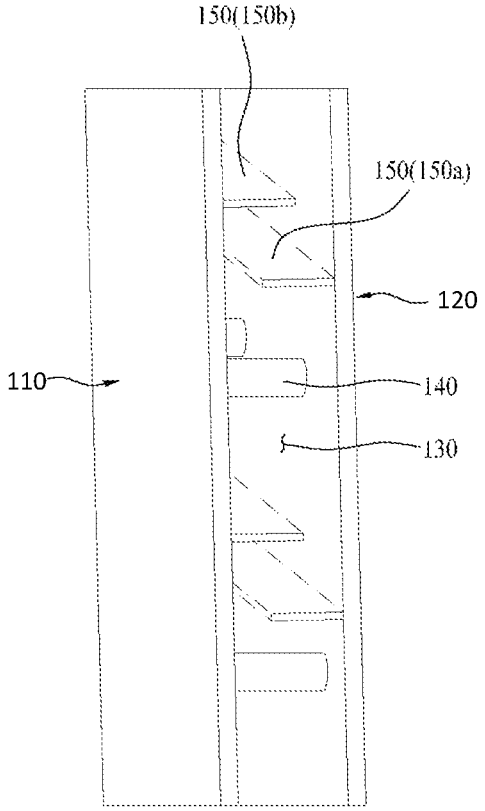

【FIG. 5】
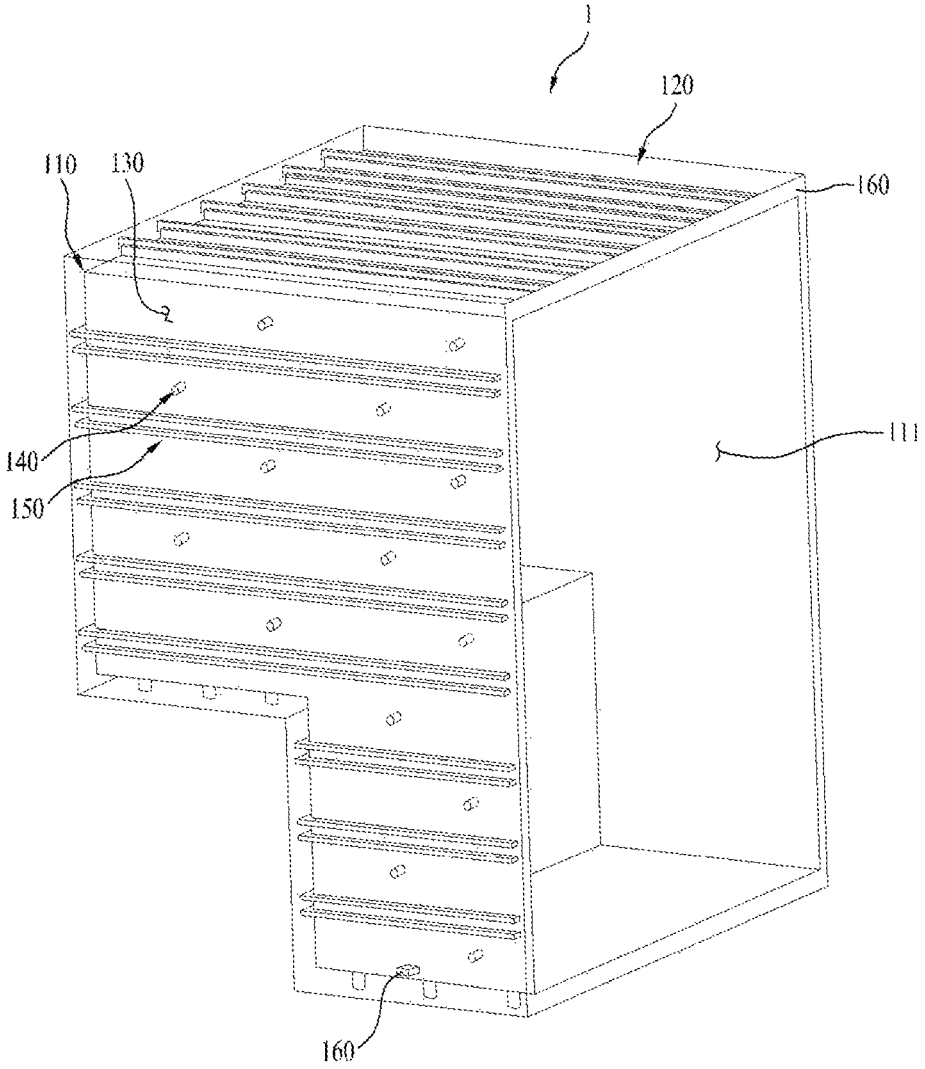

【FIG. 6 A】
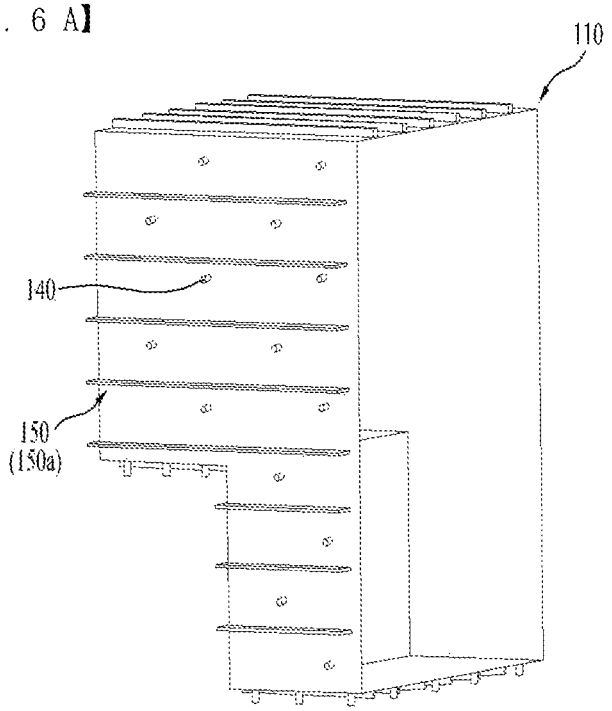
【FIG. 6 B】
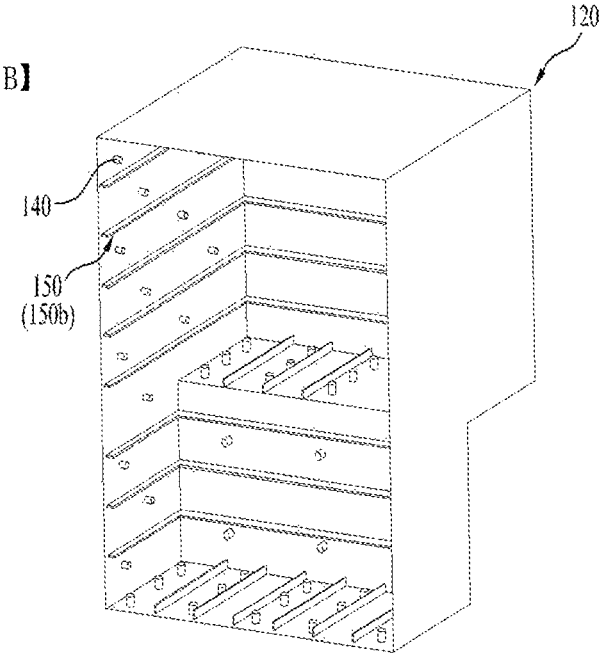

【FIG. 7】
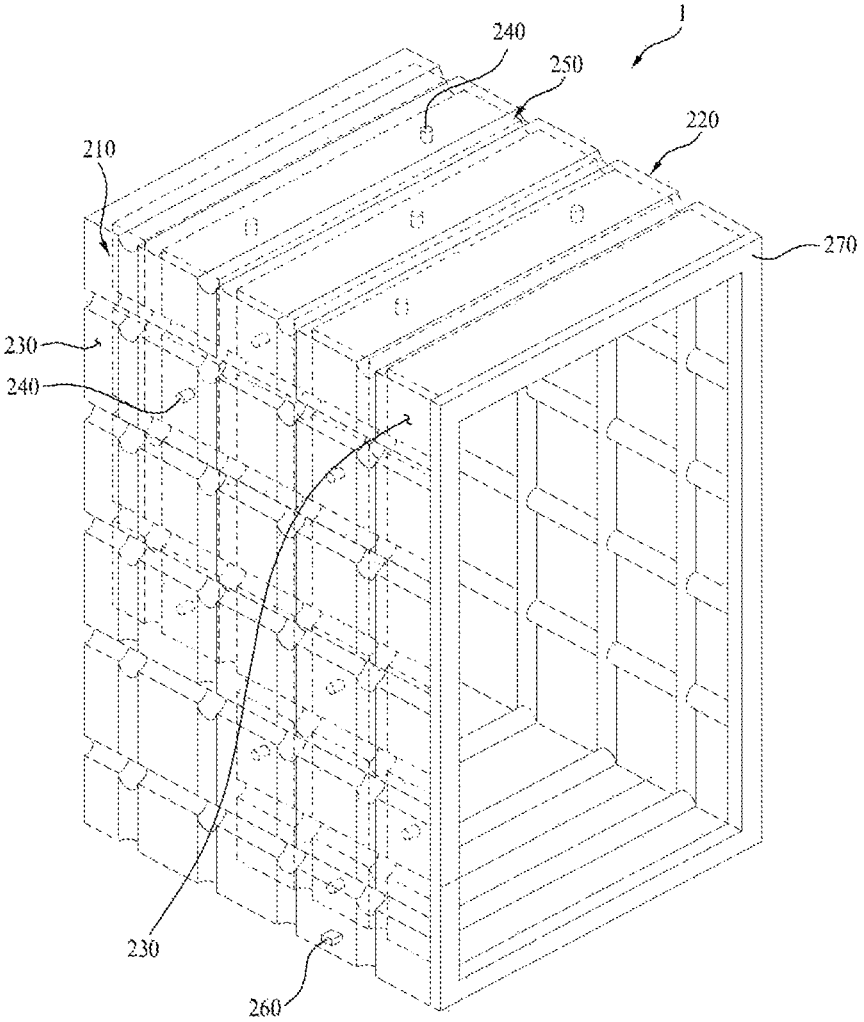

【FIG. 8 A】
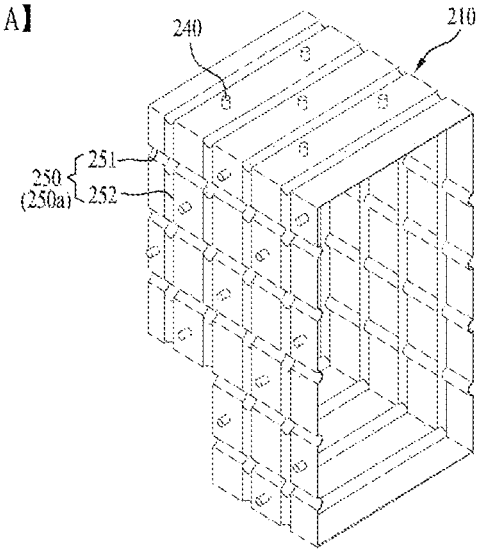
【FIG. 8 B】
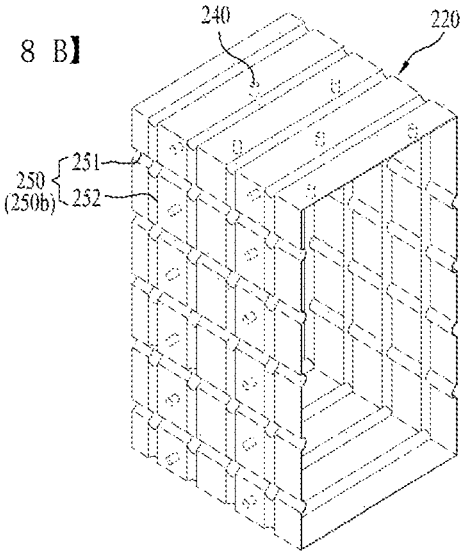

【FIG. 9】
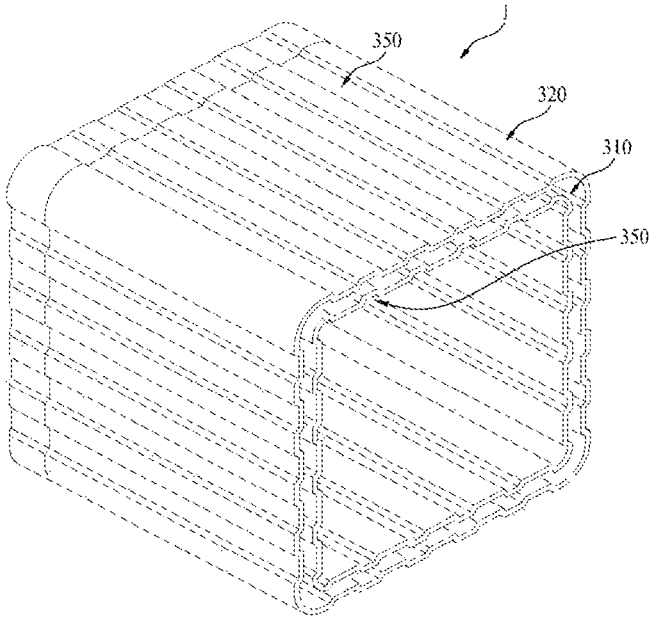

【FIG. 10 A】
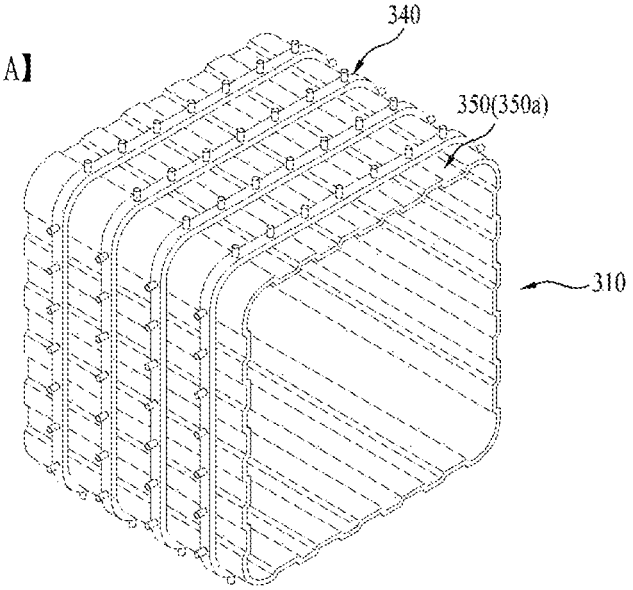
【FIG. 10 B】
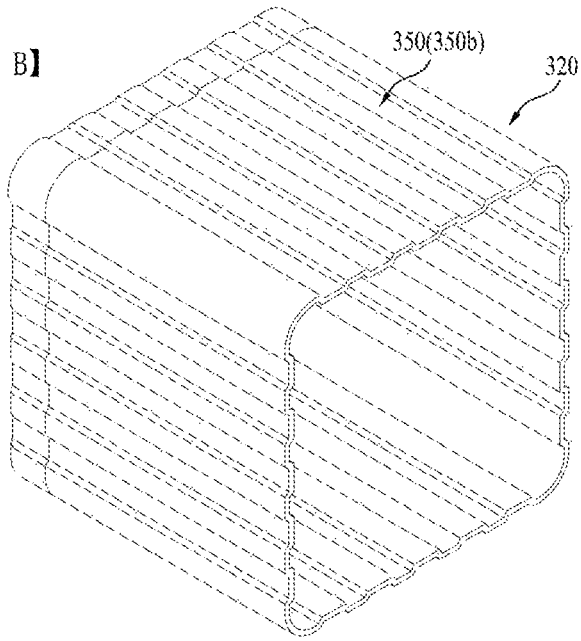

【FIG. 11 A】
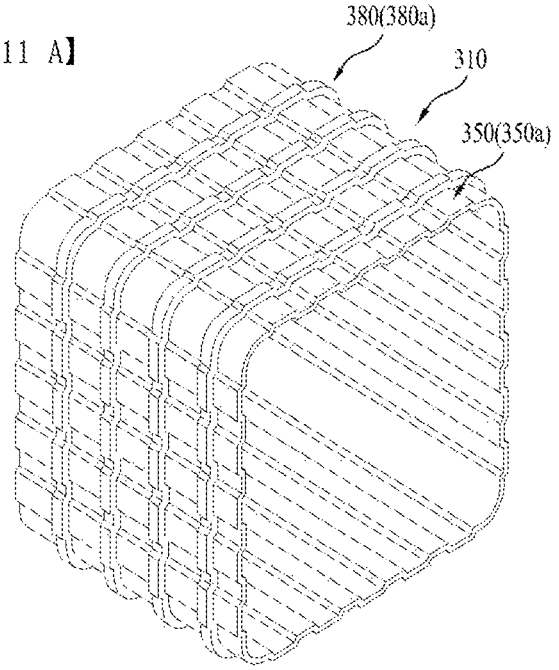
【FIG. 11 B】
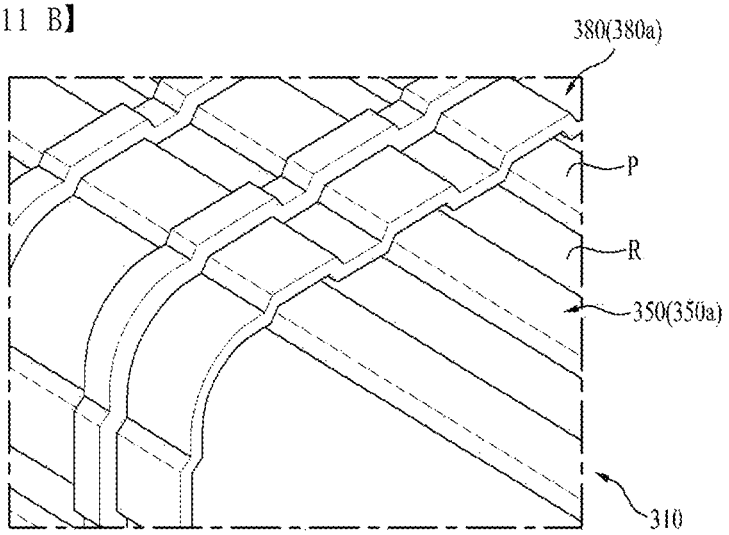

【FIG. 12 A】
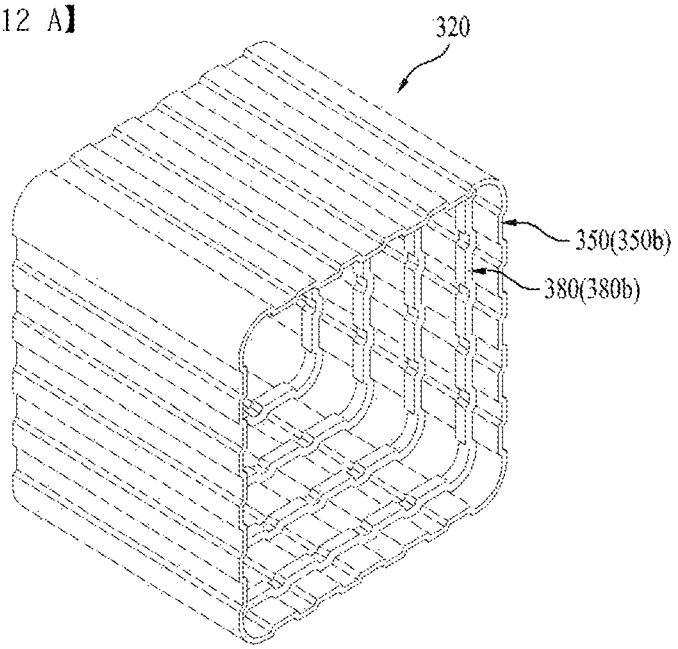
【FIG. 12 B】
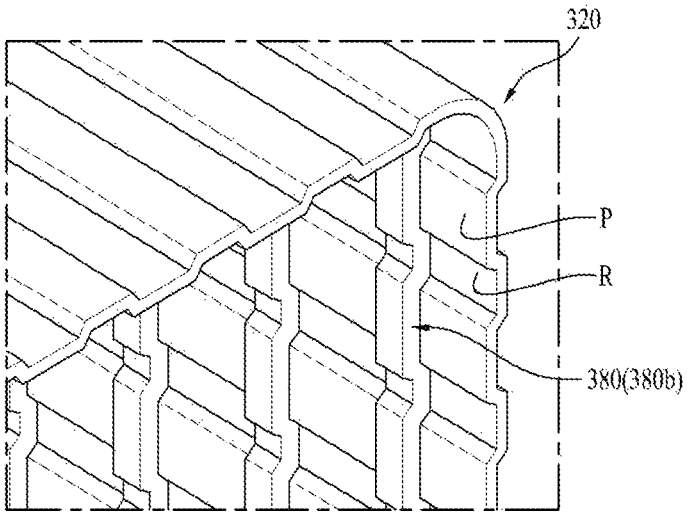

【FIG. 13】
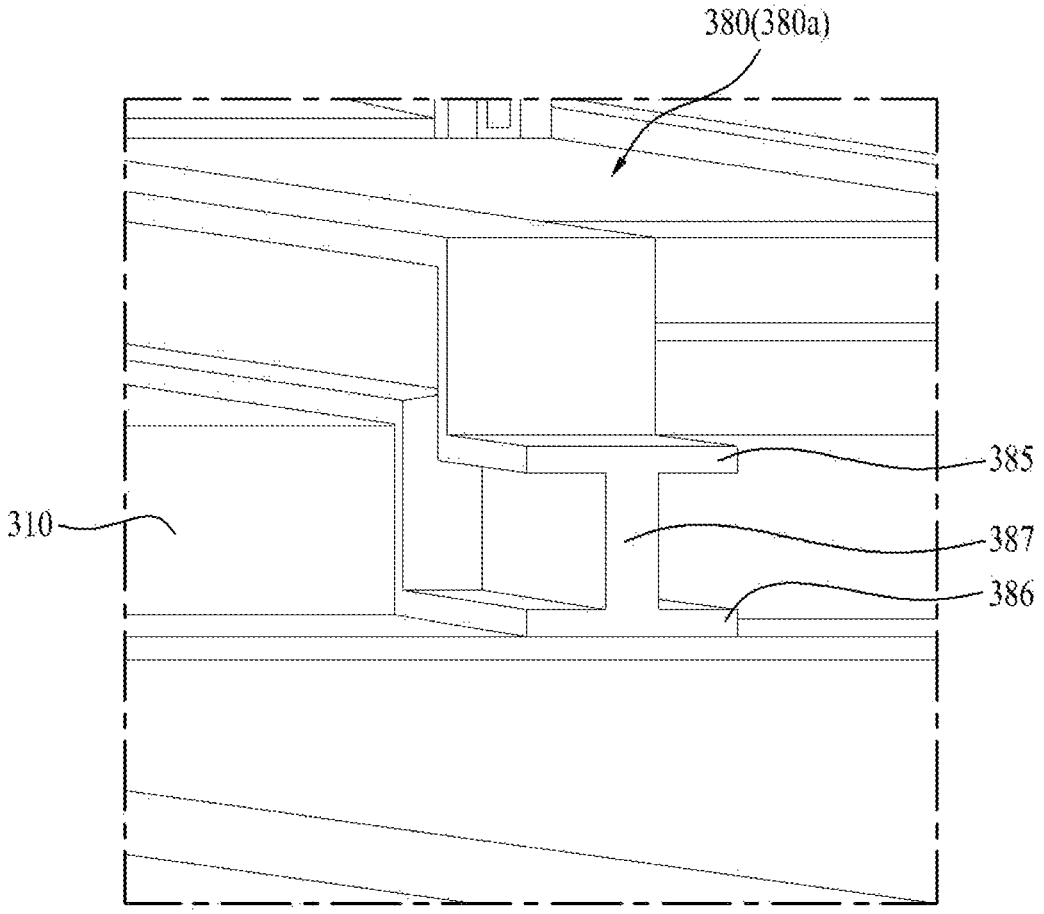

【FIG. 14】
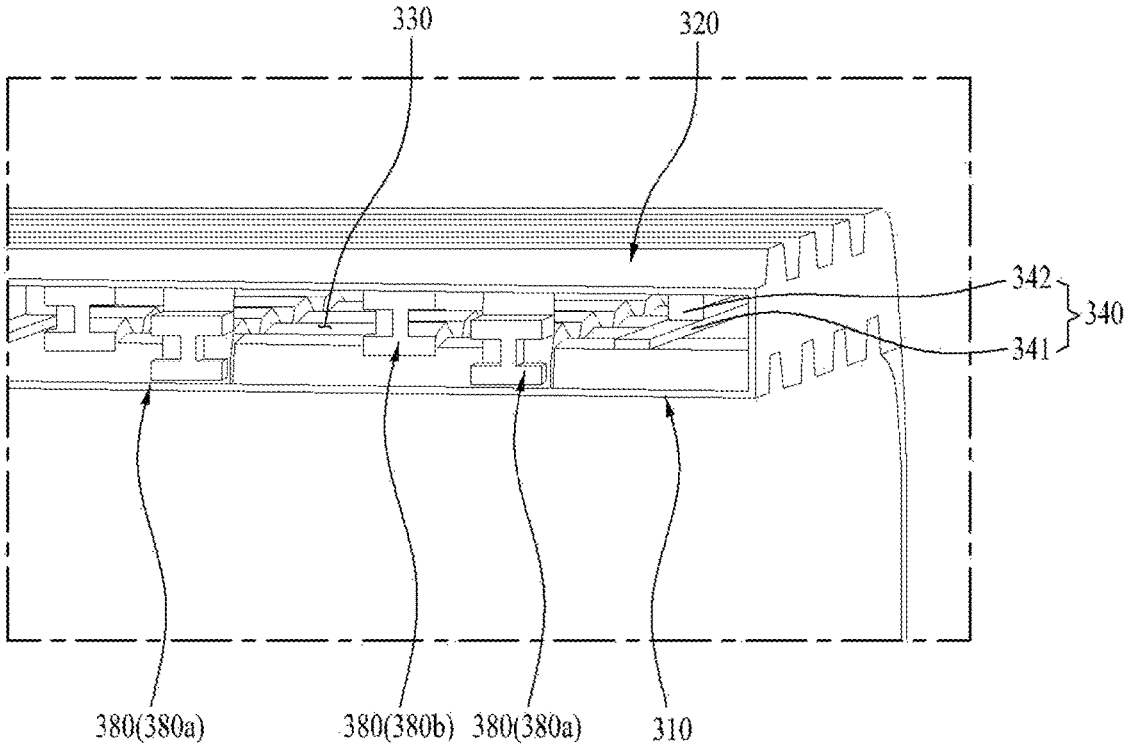

【FIG. 15】
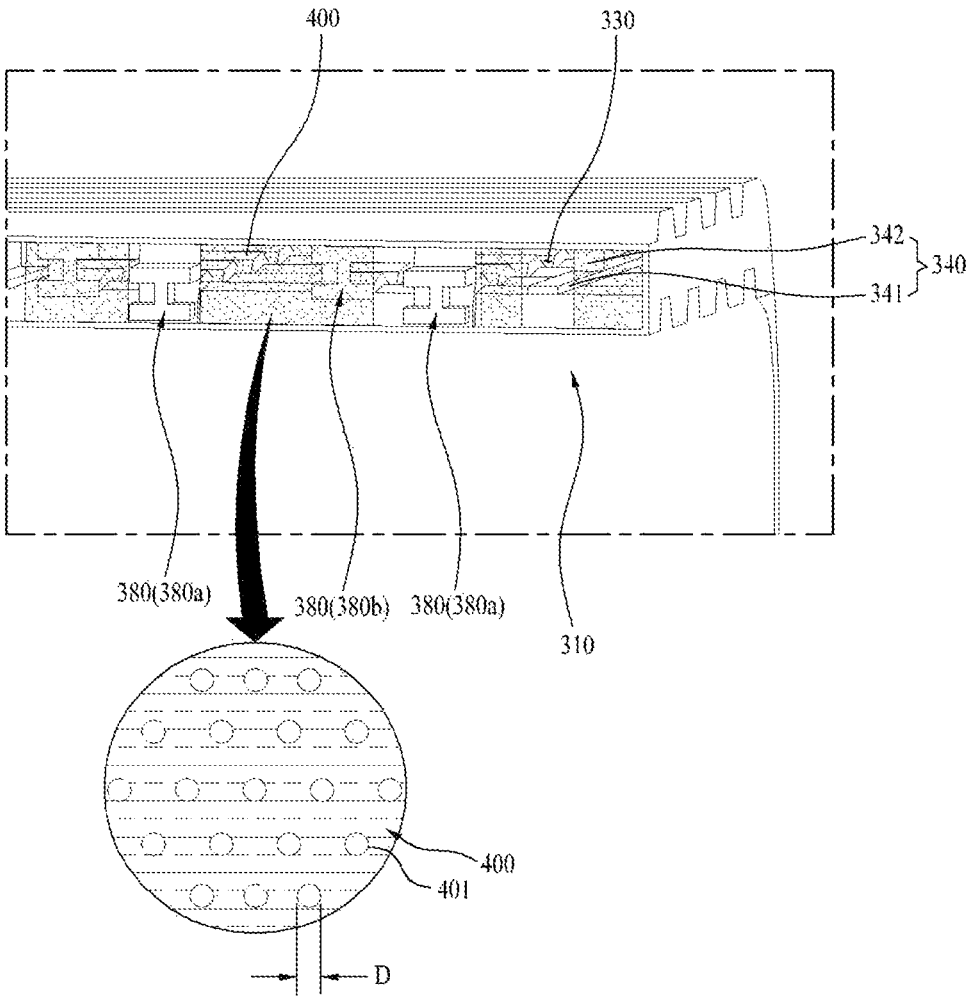

【FIG. 16】
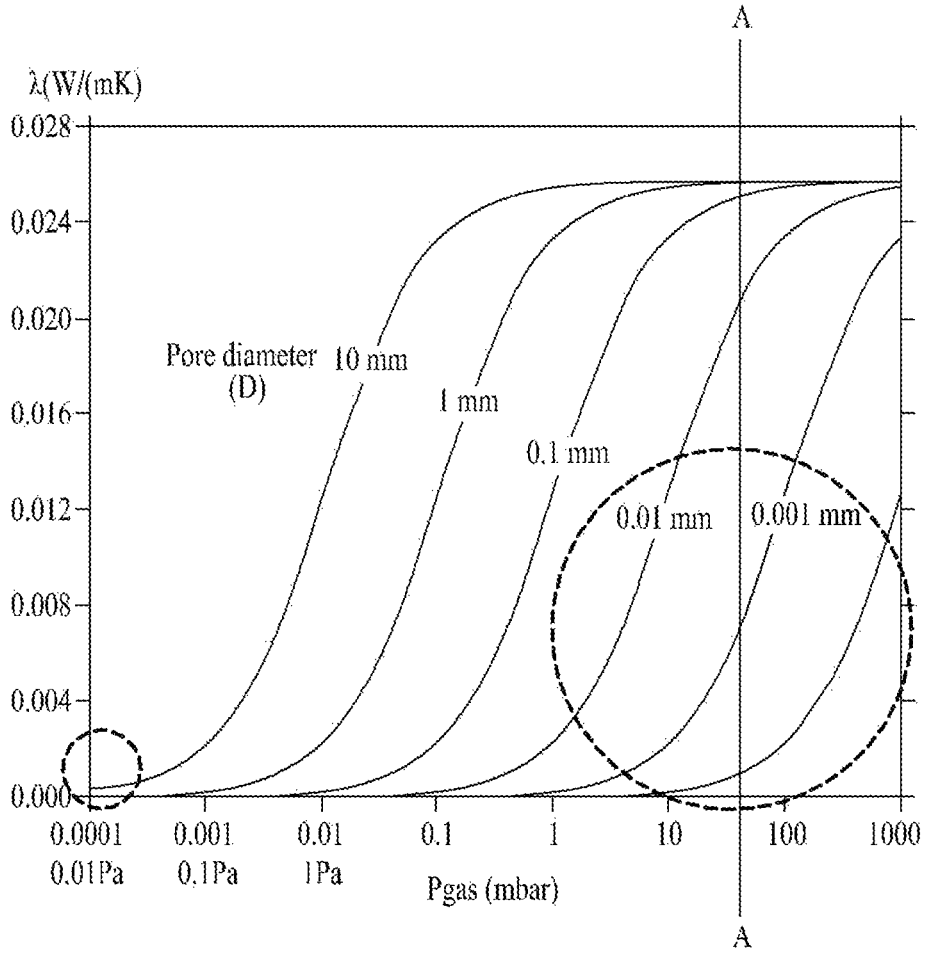

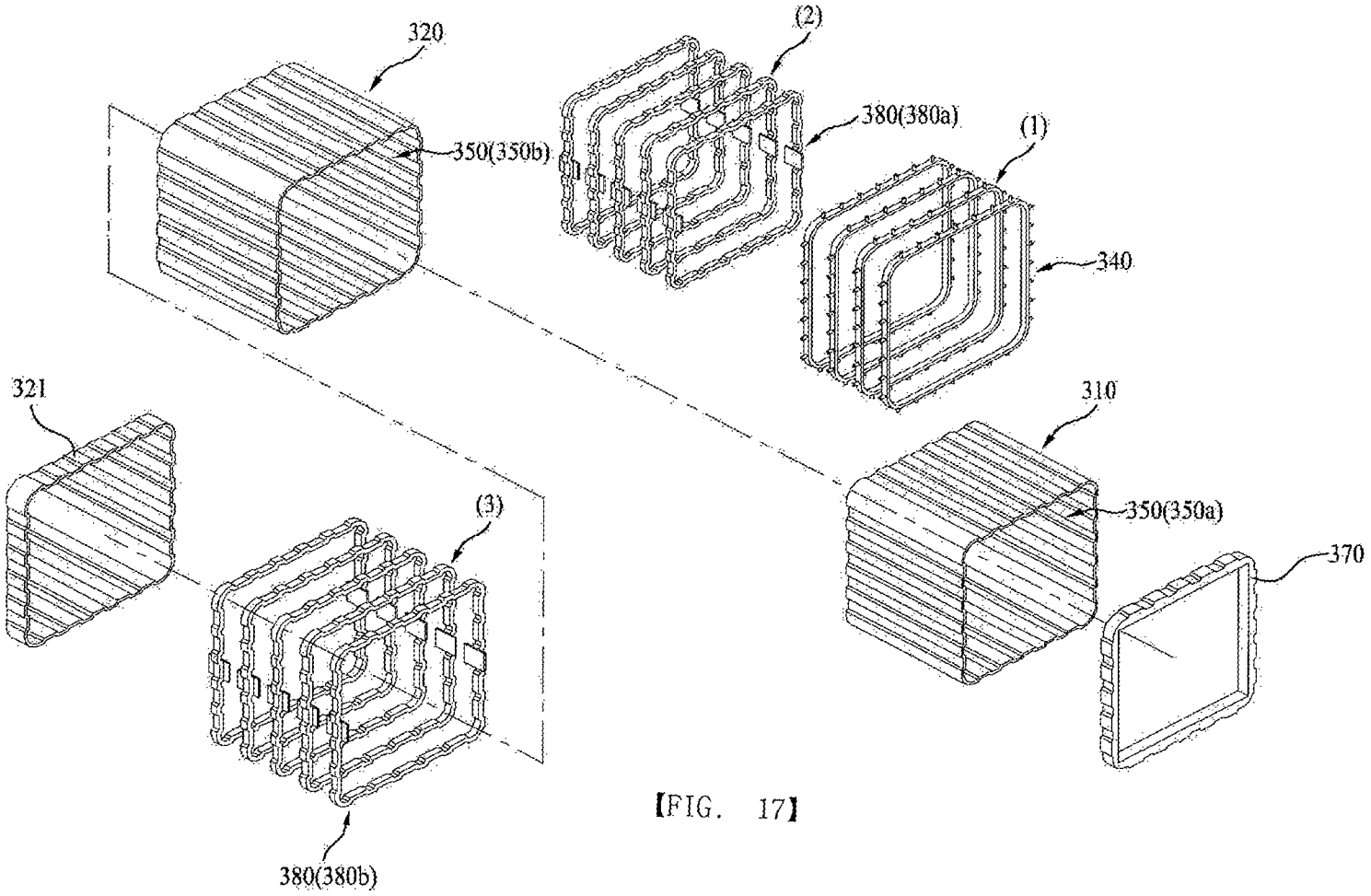
[FIG. 17]

REFRIGERATOR COMPRISING VACUUM SPACE

CROSS REFERENCE TO RELATED APPLICATIONS

This application is a continuation of U.S. application Ser. No. 15/485,365, filed on Apr. 12, 2017, now allowed, which is a continuation of U.S. application Ser. No. 14/532,144, filed Nov. 4, 2014, now U.S. Pat. No. 9,651,292, which is a continuation of U.S. application Ser. No. 13/241,725, filed Sep. 23, 2011, now U.S. Pat. No. 8,899,068, which claims priority under 35 U.S.C. § 119(a) from Korean Application No. 10-2010-0105895, filed on Oct. 28, 2010, all of which are hereby incorporated by reference as if fully set forth herein.

BACKGROUND OF THE DISCLOSURE

Field of the Disclosure

This invention relates to refrigerators, and more particularly to a refrigerator in which a vacuum space is formed between an outer case and an inner case of a body thereof for enhancing a heat insulating function.

Discussion of the Related Art

The refrigerator is a domestic appliance which forms a storage chamber temperature below zero or above zero degree for refrigerated or frozen storage of a storage object.

In general, the refrigerator is provided with the body having the storage space formed therein for storage of the storage object, and a door rotatably or slidably mounted to the body for opening/closing the storage space.

The body has the inner case to form the storage space, the outer case which houses the inner case, and an insulating material arranged between the inner case and the outer case.

The insulating material suppresses an external temperature from influencing the temperature of the storage space.

However, in order to produce an insulating effect by using the insulating material, it is required to secure a certain extent of thickness of the insulating material, implying that the insulating material becomes thicker as much, leading to have a thick wall between the inner case and the outer case, making the refrigerator bigger as much.

In the meantime, a recent trend of making the refrigerator compact calls for a requirement for making a volume of the storage space bigger while making an outside size smaller than before.

SUMMARY OF THE DISCLOSURE

Accordingly, this invention is directed to a refrigerator.

An object of this invention is to provide a refrigerator in which a vacuum space is formed between an outer case and an inner case for enhancing a heat insulating function and making an outside volume thereof compact.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body having a storage space for storing a predetermined storage object, wherein the body includes an inner case having the storage space, an outer case having an inside surface spaced a predetermined gap from an outside surface of the inner case to house the inner case, and a vacuum space provided between the inner case and the outer case sealed to maintain a vacuum state for heat insulating between the inner case and the outer case.

The refrigerator further includes a supporting portion provided to contact with, and support, the outside surface of the inner case and the inside surface of the outer case to maintain a spaced state of the inner case and the outer case.

The refrigerator further includes a reinforcing member mounted to at least one of the outside surface of the inner case and the inside surface of the outer case for reinforcing strength of the inner case or the outer case.

The reinforcing member is a reinforcing rib projected from at least one of the outside surface of the inner case or the inside surface of the outer case to a height lower than a width of the vacuum space formed between the inner case and the outer case.

The reinforcing rib is plural arranged at the outside surface of the inner case or the inside surface of the outer case spaced from one another.

The reinforcing rib includes inside reinforcing ribs provided to the outside surface of the inner case, and outside reinforcing ribs provided to an inside surface of the outer case, wherein the inside reinforcing ribs and the outside reinforcing ribs are arranged alternately not to interfere with each other.

At least one of the inside reinforcing ribs and the outside reinforcing ribs are arranged to cross one another to reinforce strength of at least one of the inner case and the outer case.

The reinforcing rib is arranged at the outside surface of the inner case or at the inside surface of the outer case in a first direction.

The reinforcing rib includes a first reinforcing rib arranged at at least one of the outside surface of the inner case or the inside surface of the outer case in the first direction, and a second reinforcing rib arranged in a second direction which crosses the first direction to cross the first reinforcing rib.

The reinforcing rib has a forming portion provided to, and projected from, at least one of the inner case and the outer case for reinforcing strength of the inner case or the outer case.

The forming portion is plural formed in the first direction.

The forming portion formed in the first direction includes an inside forming portion formed at the inner case, and an outside forming portion formed at the outer case.

The refrigerator further includes a reinforcing frame provided to at least one of the outside surface of the inner case and the inside surface of the outer case, arranged in a direction to cross a direction in which the forming portion is arranged for reinforcing strength of the inner case or the outer case.

The reinforcing frame arranged at the outside surface of the inner case is arranged in a ring shape surrounding the outside surface of the inner case connected end to end.

The reinforcing frame arranged at the inside surface of the outer case is arranged in a ring shape for supporting the inside surface of the outer case connected along the inside surface of the outer case.

The reinforcing frame has a height smaller than a width of the vacuum space formed between the inner case and the outer case.

The forming portion includes a first forming portion arranged in the first direction, and a second forming portion arranged in the second direction which crosses the first direction.

The refrigerator further includes a porous material arranged in the vacuum space for preventing at least one of heat radiation, and heat conduction caused by gas between the inner case and the outer case from taking place.

The refrigerator further includes a getter arranged in the vacuum space for absorbing gas from the vacuum space.

It is to be understood that both the foregoing general description and the following detailed description of this invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 1 illustrates a perspective view of a refrigerator in accordance with a preferred embodiment of this invention.

FIG. 2 illustrates a perspective view of a body of the refrigerator in accordance with a first preferred embodiment of this invention, with an outer case thereof removed from a side thereof.

FIGS. 3A and 3B illustrate perspective views of an inner case and an outer case of a body of a refrigerator in accordance with a first preferred embodiment of this invention, respectively.

FIG. 4 illustrates a perspective view of a portion of a vacuum space in a body of a refrigerator in accordance with a first preferred embodiment of this invention.

FIG. 5 illustrates a perspective view of a body of the refrigerator in accordance with a second preferred embodiment of this invention, with an outer case thereof removed from a top side and a side thereof.

FIGS. 6A and 6B illustrate perspective views of an inner case and an outer case of a body of a refrigerator in accordance with a second preferred embodiment of this invention, respectively.

FIG. 7 illustrates a perspective view of a body of the refrigerator in accordance with a third preferred embodiment of this invention.

FIGS. 8A and 8B illustrate perspective views of an inner case and an outer case of a body of a refrigerator in accordance with a third preferred embodiment of this invention, respectively.

FIG. 9 illustrates a perspective view of a body of the refrigerator in accordance with a fourth preferred embodiment of this invention.

FIGS. 10A and 10B illustrate perspective views of an inner case and an outer case of a body of a refrigerator in accordance with a fourth preferred embodiment of this invention, respectively.

FIGS. 11A and 11B illustrate an entire perspective view and a partial perspective view of an inner case and a reinforcing frame mounted to the inner case of a body of a refrigerator in accordance with a fifth preferred embodiment of this invention, respectively.

FIGS. 12A and 12B illustrate an entire perspective view and a partial perspective view of an outer case and a reinforcing frame mounted to the outer case of a body of a refrigerator in accordance with a fifth preferred embodiment of this invention, respectively.

FIG. 13 illustrates a cross section of a reinforcing frame in accordance with a preferred embodiment of this invention.

FIG. 14 illustrates a section of a vacuum space in a refrigerator in accordance with a fifth preferred embodiment of this invention.

FIG. 15 illustrates a section of a vacuum space in a refrigerator in accordance with a fifth preferred embodiment of this invention, showing a porous material filled in the vacuum space.

FIG. 16 illustrates a graph showing a size of a void or a pore of a porous material versus a heat insulating effect.

FIG. 17 illustrates an exploded perspective view showing an order of assembly of a refrigerator in accordance with a fifth preferred embodiment of this invention.

DESCRIPTION OF SPECIFIC EMBODIMENTS

Reference will now be made in detail to the specific embodiments of this invention, examples of which are illustrated in the accompanying drawings. Wherever possible, the same reference numbers will be used throughout the drawings to refer to the same or like parts.

Referring to FIG. 1, the refrigerator includes a body 1 having a storage chamber formed therein, a first door 4 rotatably provided to the body 1, and a second door 5 slidably provided to the body 1.

In this instance, the first door 4 has a function of, but not limited to, opening/closing a refrigerating chamber in the storage chamber, and the second door 5 has a function of, but not limited to, opening/closing a freezing chamber in the storage chamber.

FIG. 2 illustrates a perspective view of a body of the refrigerator in accordance with a preferred embodiment of this invention, with an outer case thereof removed from a top side and a side thereof.

The body 1 has a structure including an inner case 110 which forms a predetermined storage space 111 therein, and an outer case 120 which forms a space for housing the inner case 110 therein and surrounds the inner case 110. The inner case 110 and the outer case 120 function as a wall which forms an exterior of the body 1 and the storage space 111 therein.

The outer case 120 and the inner case 110 are spaced from each other to form a space which has no additional insulating material arranged therein, but only a vacuum maintained therein for heat insulation.

That is, the vacuum space 130 formed between the outer case 120 and the inner case 110 maintains a state in which a medium which transmits heat between the inner case 110 and the outer case 120 is removed therefrom.

Therefore, the influence of warm air on an outside of the outer case 120 to a temperature of the inner case 110 may be prevented.

In order to make the vacuum space 130 between the inner case 110 and the outer case 120 to maintain a shape thereof, a supporting portion 140 is required, which serves as a spacer that maintains a gap between the inner case 110 and the outer case 120. The supporting portion 140 is arranged to be in contact with an outside surface of the inner case 110 and an inside surface of the outer case 120.

The supporting portion 140 may be provided such that the supporting portion 140 is arranged projected from the outside surface of the inner case 110 to make a surface to surface contact with the inside surface of the outer case 120, or is arranged projected from the inside surface of the outer case 120 to make surface to surface contact with the outside surface of the inner case 110.

Or, the supporting portion 140 may be arranged both at the inside surface of the outer case 120 and at the outside surface of the inner case 110.

In this case, it is preferable that positions of the supporting portion 140 arranged at the inside surface of the outer case 120 and the positions of the supporting portion 140 arranged at the outside surface of the inner case 110 are, not overlap, but alternate, with one another.

In the meantime, reinforcing ribs 150 may be provided to the outside surface of the inner case 110 and the inside surface of the outer case 120 for reinforcing strength thereof, additionally.

Since thicknesses of the inner case 110 and the outer case 120 are not thick, the inner case 110 and the outer case 120 are liable to distort by an external impact, or deform at the time of evacuation to form the vacuum space 130.

Accordingly, the reinforcing ribs 150 are arranged on an outside surface of the inner case 110 or the inside surface of the outer case 120 for reinforcing the strength.

In this instance, it is preferable that the reinforcing ribs 150 are plural, and arranged spaced from one another on the outside surface of the inner case 110 or on the inside surface of the outer case 120.

In the meantime, a getter 160 is provided to the vacuum space 130 for collecting gas liable to present in the vacuum space 130, thereby preventing heat transfer caused by the gas liable to form by a chemical reaction of the outer case 120 or the inner case 110, in advance.

It is preferable that the getter 160 is provided to a ceiling or a bottom of the vacuum space 130.

The getter 160 has a substance which has a strong action of adsorbing residual gas molecules from the vacuum space 130 or making a chemical reaction therewith to form a solid compound.

Since it is difficult to obtain an adequate vacuum in the vacuum space 130 only with a vacuum pump technically, and it also costs high, the getter 160 is used.

There are different kinds of getters 160. If the getter 160 has a strong adsorbing action, the getter 160 is called as a flashed getter, and if the getter 160 is in a gaseous state with a strong chemical reaction, the getter 160 is called as a non-evaporable getter.

Presently, the getter 160 is formed of active charcoal, barium, magnesium, zirconium, red phosphorus, and so on.

In the meantime, the vacuum space 130 has a front covered with a front cover 170 which connects and seals front edges of the inner case 110 and the outer case 120.

Referring to FIG. 3, the reinforcing ribs 150 and the supporting portions 140 are arranged spaced from each other not to overlap with each other. FIG. 3A illustrates the inner case 110, and FIG. 3B illustrates the outer case 120.

Though it is shown that the reinforcing ribs 150 are arranged in a front/rear direction and a up/down direction of the inner case 110 and the outer case 120, to cross with one another, the reinforcing ribs 150 may be arranged in any one direction.

In this instance, if the reinforcing rib 150 arranged in a first direction (The front/rear direction) is called as a first reinforcing rib 151, and the reinforcing rib 150 arranged in a second direction (The up/down or left/right direction) is called as a second reinforcing rib 152, it is the most preferable that the first and second reinforcing ribs 151 and 152 are arranged to cross each other perpendicularly.

And, it is preferable that the supporting portion 140 is arranged on a surface between the reinforcing ribs 150.

In this instance, if the reinforcing ribs 150 arranged on the inside surface of the outer case 120 are called as outside reinforcing ribs 150*a*, and the reinforcing ribs 150 arranged on the outside surface of the inner case 110 are called as inside reinforcing ribs 150*b*, it is required that the outside reinforcing ribs 150*a* and the inside reinforcing ribs 150*b* are spaced not overlap with each other not to interfere with each other.

Since, if overlap, or interfere with each other, a thickness of the vacuum space 130 becomes thicker, in order to minimize the thickness of the vacuum space 130, the overlap or interference between the inside reinforcing ribs 150*b* and the outside reinforcing ribs 150*a* are prevented.

Accordingly, it is preferable that the inside reinforcing ribs 150*b* and the outside reinforcing ribs 150*a* are arranged alternately in the vacuum space 130.

That is, it is preferable that, at a particular region of the vacuum space 130, the reinforcing ribs 150 are arranged in an order of the inside reinforcing ribs 150*b*—the outside reinforcing ribs 150*a*—the inside reinforcing ribs 150*b*—the outside reinforcing ribs 150*a*.

And, it is preferable that at least one of the inside reinforcing ribs 150*a* ad the outside reinforcing ribs 150*b* are arranged in the front/rear direction or the up/down direction of the inner case 110 or the outer case 120 to cross each other.

This is because, though the reinforcing ribs 150 may perform a reinforcing function even if the reinforcing ribs 150 are arranged in one direction, if crossed, a strength reinforcing effect is great, significantly.

In the meantime, as described before, it is preferable that the supporting portion 140 is arranged between the reinforcing ribs 150 in the up/down direction and the front/rear direction spaced from one another in plural.

This is for maintaining a gap between the inner case 110 and the outer case 120 of the vacuum space 130 on the whole.

FIG. 4 illustrates a perspective view of a portion of a vacuum space 130 in accordance with a preferred embodiment of this invention, showing the inside reinforcing ribs 150*a* and the outside reinforcing ribs 150*b* arranged spaced from each other not to overlap with each other.

In the meantime, it is preferable that each of the outside reinforcing ribs 150*b* and the inside reinforcing ribs 150*a* has a projected length or a projected height smaller than the vacuum space 130, for preventing the outside reinforcing ribs 150*b* from being in contact with the outside surface of the inner case 110, or the inside reinforcing ribs 150*a* from being in contact with the inside surface of the outer case 120.

If the there is the contact of the reinforcing rib 150, since the heat transfer is liable to take place through the portion, in order to prevent this from taking place, it is preferable that the projected length or the projected height of each of the outside reinforcing ribs 150*b* and the inside reinforcing ribs 150*a* is formed smaller than the width of the vacuum space 130.

In the meantime, it is required that the supporting portion 140 has a size matched to the width of the vacuum space 130 for the supporting portion 140 to perform a function of maintaining the width of the vacuum space 130.

However, since the heat transfer is liable to take place through the supporting portion 140, it is preferable that a number of the supporting portion 140 is minimized as far as the width of the vacuum space 130 is maintained by the supporting portion 140.

FIG. 5 illustrates a perspective view of a body of the refrigerator in accordance with a second preferred embodiment of this invention, with an outer case thereof removed from a top side and a side thereof, showing the reinforcing ribs 150 arranged in one direction in the vacuum space 130.

Though the embodiment suggests the reinforcing ribs 150 arranged only in the front/rear direction, the reinforcing ribs 150 may be arranged in the up/down direction or the left/right direction.

Though FIGS. 6A and 6B illustrate perspective views of an inner case and an outer case of a body of a refrigerator in accordance with a second preferred embodiment of this invention respectively, showing the reinforcing ribs 150 arranged at the inner case 110 and the outer case 120 respectively, the reinforcing ribs 150 may be arranged only at the inner case 110 or only at the outer case 120.

Of the reinforcing ribs 150, the inside reinforcing ribs 150*a* are arranged at side surfaces, a top surface and an underside surface of the outside wall of the inner case 110 in the front/rear direction.

And, of the reinforcing ribs 150, the outside reinforcing ribs 150*b* are arranged at side surfaces, a top surface and a bottom surface of the inside wall of the outer case 120 in the front/rear direction.

The supporting portion 140 is arranged between the reinforcing ribs 150.

In this instance too, alike the first embodiment, it is important that the reinforcing ribs 150 formed at any one of the cases 110 and 120 are not in contact with the other one of the cases 110 and 120.

According to this, it is preferable that a projected length or projected height of the reinforcing rib 150 is smaller than a projected height or a projected length of the supporting portion 140.

And, if both the inside reinforcing ribs 150*a* and the outside reinforcing ribs 150*b* are provided, it is preferable that the inside reinforcing ribs 150*a* and the outside reinforcing ribs 150*b* are arranged spaced from each other or alternately not to interfere with each other.

FIG. 7 illustrates a perspective view of a body of the refrigerator in accordance with a third preferred embodiment of this invention, and FIGS. 8A and 8B illustrate perspective views of an inner case and an outer case of a body of a refrigerator in accordance with a third preferred embodiment of this invention respectively, showing forming portions 250 for reinforcing strength of the inner case 210 and the outer case 220 instead of the reinforcing ribs 150.

The forming portion 250 is continuous curved surfaces of the inner case 210 and the outer case 220 formed in one direction along the surfaces of the inner case 210 and the outer case 220.

The forming portion 250 in the inner case 210 is called as an inside forming portion 250*a*, and the forming portion 250 in the outer case 220 is called as an outside forming portion 250*b*.

The inside forming portion 250*a* are projected inward from sides, a top side, a bottom side and a rear side of the inner case 210. However, the inside forming portion 250*a* may be projected outward.

And, the outside forming portion 250*b* is also projected outward from sides, a top side, a bottom side and a rear side of the outer case 220.

Alike the projected height or projected length of the reinforcing rib 150 in the first or second embodiment formed smaller than the width of the vacuum space 130 between the inner case 110 and the outer case 120, it is preferable that an extent of projection of the forming portion 250 is smaller than the width of the vacuum space 230 between the inner case 210 and the outer case 220.

As described before, this is for preventing the heat transfer between the inner case 210 and outer case 220 through the forming portion 250 from taking place.

In the meantime, there is a supporting portion 240 provided to the outside surface of the inner case 210 or to the inside surface of the inner case 210 for maintaining a gap or a width of the vacuum space 230 between the inner case 210 and the outer case 220.

It is preferable that the supporting portion 240 is formed on a flat surface provided adjacent to the forming portion 250.

Alike the inside reinforcing ribs 150*a* and the outside reinforcing ribs 150*b* made not to be in contact with each other, it is preferable that the inside forming portion 250*a* and the outside forming portion 250*b* are arranged not to be in contact or interfere with each other.

A minimized width of the vacuum space 230 owing to arrangement of the inside forming portion 250*a* and the outside forming portion 250*b* may contribute to make the refrigerator compact.

Referring to FIGS. 7, 8A and 8B, the forming portion 250 includes a first forming portion 251 arranged in a first direction, or a front/rear direction, and a second forming portion 252 in a second direction to cross the first direction, or an up/down direction or a left/right direction.

The first forming portion 251 and the second forming portion 252 are arranged to cross each other for making effective strength reinforcement of the inner case 210 and the outer case 220.

It is preferable that the first forming portion 251 are plural spaced from one another, and the second forming portion 252 are also plural spaced from one another.

And, if the first forming portion 251 and the second forming portion 252 are provided to cross each other to reinforce the strength of the inner case 210 and the outer case 220, no additional reinforcing member will be required.

An unexplained reference numeral 260 denotes a getter, and 270 denotes a front cover for blocking a front of the vacuum space 230 to seal the vacuum space 230.

In the meantime, FIG. 9 illustrates a perspective view of a body of the refrigerator in accordance with a fourth preferred embodiment of this invention, and FIGS. 10A and 10B illustrate perspective views of an inner case and an outer case of a body of a refrigerator in accordance with a fourth preferred embodiment of this invention respectively, wherein the case also has an inner case 310 and an outer case 320 which houses the inner case 310.

There is a supporting portion 340 provided to an outside surface of the inner case 310 or to the inside surface of the outer case 320 for maintaining a gap between the inner case 310 and the outer case 320.

However, a forming portion 350 in the fourth embodiment is different from the forming portion 250 in the third embodiment described with reference to FIGS. 7, 8A and 8B in that the forming portion 350 in the fourth embodiment is arranged in a particular direction, specifically, in a front/rear direction, continuously. However, the forming portion 350 may be arranged in a left/right direction or an up/down direction, continuously.

In this instance too, of the forming portion s 350, one formed on the outer case 320 will be called as an outside forming portion 350*b*, and one formed on the inner case 310 will be called as an inside forming portion 350*a*.

What is important in the embodiment is that the forming portion 350 is arranged only in one of the first and second directions.

The forming portion 350 arranged only in one direction thus has an advantage in that a structure of a mold for forming the case may become simpler than a case of FIGS. 7, 8A and 8B.

However, even though the forming portion 350 arranged only in one direction is in a superior position in view of time and cost to the case of FIGS. 7, 8A and 8B, the forming portion 350 is in an inferior position in view of strength reinforcement.

Therefore, it is desirable to mount an additional member for strength reinforcement.

FIGS. 11A and 11B illustrate an entire perspective view and a partial perspective view of an inner case and a reinforcing frame 380 mounted to the inner case of a body of a refrigerator in accordance with a fifth preferred embodiment of this invention respectively, and FIGS. 12A and 12B illustrate an entire perspective view and a partial perspective view of an outer case and a reinforcing frame 380 mounted to the outer case of a body of a refrigerator in accordance with a fifth preferred embodiment of this invention, respectively.

Of the reinforcing frame 380, the reinforcing frame 380 arranged at the inner case 310 is defined as an inside reinforcing frame 380*a*, and the reinforcing frame 380 arranged at the outer case 320 is defined as an outside reinforcing frame 380*b*.

Referring to FIGS. 11A and 11B, it is preferable that the inside reinforcing frame 380*a* is provided in a shape of a band or a ring which surrounds the outside surface of the inner case 310 in plural space from one another.

By arranging the inside reinforcing frame 380*a* to cross a direction of arrangement of the inside forming portion 350*a*, to form a resistance force against external force applied in a direction the inside forming portion 350*a* fails to cover, deformation of the inner case may be prevented.

As shown in the drawings, if the inside forming portion 350*a* is arranged in the front/rear direction, it is preferable that the inside reinforcing frame 380*a* is arranged in the left/right direction at the top side surface and the bottom side surface of the inner case 310, and in an up/down direction at the sides of the inner case 310.

If a projection P and a recess R of the inside forming portion 350*a* are formed in the surface of the inner case 310, the inside reinforcing frame 380*a* is arranged in conformity with shapes of the projection P and the recess R.

That is, a portion of the inside reinforcing frame 380*a* in contact with the projection P is arranged projected outward as much as the projection, and a portion of the inside reinforcing frame 380*a* in contact with the recess R between the inside forming portion s 350*a* is arranged in a recessed shape.

Referring to FIGS. 12A and 12B, the outside reinforcing frame 380*b* is arranged at an inside surface of the outer case 320 for reinforcing strength of the outer case 320.

It is preferable that the inside reinforcing frame 380*a* is provided in a shape of a band or a ring (A closed loop type) which is arranged along the inside surface of the outer case 320 in plural spaced from one another.

By arranging the outside reinforcing frame 380*b* to cross a direction of arrangement of the outside forming portion 350*b*, to form a resistance force against external force applied in a direction the outside forming portion 350*b* fails to cover, deformation of the outer case 320 may be prevented.

As shown in the drawings, if the outside forming portion 350*b* is arranged in the front/rear direction, it is preferable that the outside reinforcing frame 380*b* is arranged in the left/right direction at the top side surface and the bottom side surface of an inside of the outer case 320, and in an up/down direction at the sides of the outer case 320.

And, if the projection P and the recess R of the outside forming portion 350*b* are formed at the surface of the outer case 320, the outside reinforcing frame 380*b* is arranged in conformity with the shapes of the projection P and the recess R.

That is, a portion of the outside reinforcing frame 380*b* in contact with the projection of the outside forming portion 350*b* is projected as much as the projection, and a portion of the outside reinforcing frame 380*b* in contact with the recess R between the outside forming portion s 350*b* is recessed inward more than the projected portion.

FIG. 13 illustrates a cross section of the inside reinforcing frame 380*a* which is one of the reinforcing frames 380 arranged along the outside surface of the inner case 310.

The inside reinforcing frame 380*a* has an "I" section or an "I" section laid down in a horizontal direction.

That is, the "I" section has a top side 385 width and a bottom side 386 width larger than a middle portion 387.

The inside reinforcing frame 380*a* has such a cross section for saving material while providing a high resistance force against an external force higher than an "I" without the top side 385 and the bottom side 386 with widths larger than the middle portion 387.

If it preferable that the shape of the cross section of the inside reinforcing frame 380*a* is applied to the outside reinforcing frame 380*b*, too.

FIG. 14 illustrates a section of a vacuum space in a refrigerator in accordance with a fifth preferred embodiment of this invention, showing the inner case 310 and the outer side case 320 coupled together.

In this instance, it is preferable that each of the inside reinforcing frame 380*a* and the outside reinforcing frame 380*b* has a height lower than a height or a width of the vacuum space 330 between the inner case 310 and the outer case 320.

This is for minimizing heat transfer between the inner case 310 and the outer case 320.

Therefore, it is required that the top side of the inside reinforcing frame 380*a* arranged at the outside surface of the inner case 310 is spaced a distance from the inside surface of the outer case 320.

On the other hand, it is required that the bottom side of the outside reinforcing frame 380*b* arranged at the inside surface of the outer case 320 is spaced a distance from the outside surface of the inner case 310.

In the meantime, there is a supporting portion 340 provided between the outer case 320 and the inner case 310 for preventing the vacuum space 330 from deforming.

That is, the supporting portion 340 is in contact both with the inside surface of the outer case 320 and the outside surface of the inner case 310 for maintaining a gap between the outer case 320 and the inner case 310.

According to this, deformation of the vacuum space 330 between the outer case 320 and the inner case 310 is prevented.

Though the supporting portion 340 may be formed in a shape of boss or a column having a width or a height, FIG.

14 illustrates the supporting portion 340 including a base portion 341 which surrounds the inner case 310 and a supporting member 342 projected from the base portion 341 to one side.

In this instance, it is preferable that the supporting member 342 is arranged spaced from one another along the base portion 341.

However, it is also viable that the supporting portion 340 is attached to the inside surface of the outer case 320 and the supporting member 342 is projected to the outside surface of the inner case 310 such that the supporting member 342 is in contact with the outside surface of the inner case 310.

Referring to FIG. 14, a space excluding the inside reinforcing frame 380*a*, the outside reinforcing frame 380*b* and the supporting portion 340 is an empty space to form the vacuum space 330.

FIG. 15 illustrates a section of a vacuum space 330 in a refrigerator in accordance with a fifth preferred embodiment of this invention, showing a porous material 400 filled in the vacuum space 330.

Though the vacuum space 330 is aiming at an ideal vacuum state by removing air and other remained gases therefrom to achieve a heat transfer rate of zero, it is difficult to exclude a case in which the vacuum space 330 contains a certain extent of gas.

Since such gas may cause slight heat transfer, in order to cut off such heat transfer effectively, an insulating member 400 having voids or pores 401 of a predetermined size therein is arranged in the vacuum space 330.

Though the void or pore 401 may be an activity space of a gas particle, the insulating member 400 with the voids or pores 401 having small diameters limits the movement of the gas particle which may become a medium of the heat transfer to suppress the heat transfer.

Anyhow, the insulating member 400 is different from the related art insulating material or a vacuum insulating material in that the vacuum space 330 serves as a major heat insulating function and the member with the pores 401 serves as a supplementary heat insulating function.

The smaller a diameter D of the void or pore 401 in the porous material 400, the higher the heat insulating effect.

Referring to FIG. 16, it can be known that the smaller the diameter of the void or pore, the lower the heat transfer rate even under the same pressure (A line).

FIG. 17 illustrates an exploded perspective view showing an order of assembly of the inner case 310, the outer case 320, the inside reinforcing frame 380*a*, the outside reinforcing frame 380*b*, and the supporting portion 340.

At first, the inner case 310 having the inside forming portion 350*a* is placed in the outer case 320 having the outside forming portion 350*b*.

In this instance, even though a rear of the inner case 310 is closed and a front of the inner case 310 is opened, both a front and a rear of the outer case 320 are opened.

The rear of the outer case 320 is opened for placing the inside reinforcing frame 380*a*, the outside reinforcing frame 380*b*, and the supporting portion 340 between the outer case 320 and the inner case 310 through the opened rear.

Once the inner case 310 is placed in the outer case 320, the space is formed between the inner case 310 and the outer case 320.

The space becomes the vacuum space 330, later.

However, in order to maintain the space, and reinforce strength of the inner case 310 and the outer case 320, one of the supporting portions 340 is placed in the space (Step 1).

The supporting portion 340 placed in thus maintains the gap between the inner case 310 and the outer case 320.

After placing in the supporting portion 340 thus, one of the inside reinforcing frames 380*a* is placed in the space so as to be arranged at the outside surface of the inner case 310 spaced from the supporting portion 340 (Step 2).

It is required that the inside reinforcing frame 380*a* is spaced from the inside surface of the outer case 320.

Then, one of the outside reinforcing frame 380*b* is placed in the space so as to be arranged at the inside surface of the outer case 320 spaced form the inside reinforcing frame 380*a* arranged thus (Step 3).

It is required that the outside reinforcing frame 380*b* is spaced from the outside surface of the inner case 310.

Then, the steps 1-2-3 are repeated.

However, when the steps 1-2-3 are repeated, an order of arrangement of the supporting portion 340, the inside reinforcing frame 380*a*, and the outside reinforcing frame 380*b* may be changed.

When the steps 1-2-3 are repeated, the porous material 400 described with reference to FIG. 15 may be placed therein.

Upon finishing alternated arrangement of the supporting portion 340, inside reinforcing frame 380*a*, and the outside reinforcing frame 380*b*, the opened rear of the outer case 320 is closed with a rear cover 321.

And, front edges of the inner case 310 and the outer case 320 are covered with a front cover 370, to seal the space.

Then, the space is evacuated, to make the space to be the vacuum space 330.

Upon forming the vacuum space 330 between the inner case 310 the outer case 320 thus, a heat insulating function significantly effective more than any insulating material may be performed.

And, in a case of the insulating material, though thicker insulating material is required for more effective insulation, since the vacuum heat insulation may perform heat insulation regardless of the thickness of the vacuum layer, the vacuum heat insulation permits fabrication of a refrigerator having a thin heat insulating layer.

As has been described, the refrigerator of this invention has the following advantages.

The refrigerator of this invention has, not a general insulating material, but a vacuum space formed between the inner case and the outer case for suppressing heat transfer between the inner case and the outer case.

Since a heat insulating effect of the vacuum is significantly better than a heat insulating effect of the general insulating material, the refrigerator of this invention has a heat insulating effect better than the related art refrigerator.

In the meantime, in a case of the vacuum space, the heat insulating is made available only when a vacuum state is maintained regardless of the thickness (A gap between the inner case and the outer case, in a case of the general insulating material, it is required to make a thickness of the insulating material thicker to enhance the heat insulating effect, which thickness increase increases a size of the refrigerator.

Therefore, in comparison to the related art refrigerator, since the refrigerator of this invention permits to an outside size thereof while maintaining the storage space the same, a compact refrigerator can be provided.

It will be apparent to those skilled in the art that various modifications and variations can be made in this invention without departing from the spirit or scope of the inventions. Thus, it is intended that this invention covers the modifications and variations of this invention provided they come within the scope of the appended claims and their equivalents.

What is claimed is:

1. A home appliance or a vacuum wall, comprising:

an inner case;

an outer case spaced apart from the inner case, wherein the inner case and the outer case define a vacuum space disposed between the outer case and the inner case and configured to insulate the outer case from the inner case;

a reinforcing member provided to at least one of a surface of the inner case or a surface of the outer case and configured to prevent the inner case and the outer case from being distorted by an external impact or being deformed during an evacuation process to form the vacuum space; and a getter provided to the vacuum space and configured to collect gas liable to present in the vacuum space, thereby preventing heat transfer caused by the gas liable to form by a chemical reaction of the outer case or the inner case, wherein the reinforcing member is projected from at least one of the surface of the inner case or the surface of the outer case.

2. The home appliance or the vacuum wall according to claim 1, wherein the reinforcing member is arranged at the surface of the inner case or at the surface of the outer case in a first direction.

3. The home appliance or the vacuum wall according to claim 1, wherein the reinforcing member is configured to extend in a longitudinal direction along the surface of the inner case or the surface of the outer case.

4. The home appliance or the vacuum wall according to claim 1, wherein the reinforcing member is disposed at least one of at a corner of the inner case or at a corner of the outer case.

5. The home appliance or the vacuum wall according to claim 1, wherein the reinforcing member extends towards a corner of the inner case or the outer case.

6. The home appliance or the vacuum wall according to claim 1, wherein the reinforcing member extends to cross at a corner of the inner case or the outer case.

7. The home appliance or the vacuum wall according to claim 1, wherein the reinforcing member extends from a first corner of the inner case or the outer case to a second corner of the inner case or the outer case.

8. The home appliance or the vacuum wall according to claim 1, wherein the reinforcing member extends from a first corner of the inner case or the outer case to an edge of the inner case or the outer case.

9. The home appliance or the vacuum wall according to claim 1, wherein the reinforcing member is configured to extend in a first direction along an outer surface of the inner case or an inner surface of the outer case, the first direction being perpendicular to a protrusion direction of the reinforcing member.

10. The home appliance or a vacuum wall according to claim 1, wherein edges of the inner case and the outer case are configured to be connected to seal the vacuum space.

11. The home appliance or a vacuum wall according to claim 1, wherein the reinforcing member has a height smaller than a width of the vacuum space defined between the inner case and the outer case, and has a length along an extended direction of the reinforcing member larger than a width of the vacuum space defined between the inner case and the outer case.

12. The home appliance or a vacuum wall according to claim 1, wherein the reinforcing member has a height smaller than a width of the vacuum space defined between the inner case and the outer case, and has a length in an extended direction of the reinforcing member larger than a width of the vacuum space defined between the inner case and the outer case.

13. The home appliance or a vacuum wall according to claim 1, wherein the reinforcing member is placed in the vacuum space and configured to reinforce strength of the inner case and the outer case prior to sealing the vacuum space.

14. The home appliance or a vacuum wall according to claim 1, wherein the getter is provided to a ceiling or a bottom of the vacuum space.

15. The home appliance or the vacuum wall according to claim 1, wherein the reinforcing member has a curved shape that extends along the surface of the inner case or the surface of the outer case.

16. A home appliance or a vacuum wall comprising:

an inner case;

an outer case spaced apart from the inner case, wherein the inner case and the outer case define a vacuum space disposed between the outer case and the inner case and configured to insulate the outer case from the inner case;

a reinforcing member provided to at least one of a surface of the inner case or a surface of the outer case and configured to prevent the inner case and the outer case from being distorted by an external impact or being deformed during an evacuation process to form the vacuum space; and a getter provided to the vacuum space and configured to collect gas liable to present in the vacuum space, thereby preventing heat transfer caused by the gas liable to form by a chemical reaction of the outer case or the inner case, wherein the reinforcing member has a shape having at least two corners, and is arranged along the surface of the inner case or the surface of the outer case.

17. The home appliance or the vacuum wall according to claim 16, wherein the reinforcing member is arranged in a shape surrounding the surface of the inner case or the surface of the outer case.

18. The home appliance or the vacuum wall according to claim 16, wherein the reinforcing member is arranged in a shape to support the surface of the inner case or the surface of the outer case.

19. The home appliance or the vacuum wall according to claim 16, wherein the reinforcing member is arranged at an upper wall, a lower wall, a left wall, and a right wall that define the inner case or the outer case.

20. A home appliance or a vacuum wall comprising:

an inner case;

an outer case spaced apart from the inner case, wherein the inner case and the outer case define a vacuum space disposed between the outer case and the inner case and configured to insulate the outer case from the inner case;

a reinforcing member provided to at least one of a surface of the inner case or a surface of the outer case and configured to prevent the inner case and the outer case from being distorted by an external impact or being deformed during an evacuation process to form the vacuum space; and a getter provided to the vacuum space and configured to collect gas liable to present in the vacuum space, thereby preventing heat transfer caused by the gas liable to form by a chemical reaction of the outer case or the inner case, wherein the reinforcing member is disposed at least one of at an edge of the inner case or at an edge of the outer case.

21. The home appliance or the vacuum wall according to claim 20, wherein the reinforcing member extends towards an edge of the inner case or an edge of the outer case.

22. The home appliance or the vacuum wall according to claim 20, wherein the reinforcing member extends to near an edge of the inner case or an edge of the outer case.

23. The home appliance or the vacuum wall according to claim 20, wherein the reinforcing member has a shape corresponding to a front edge of the inner case.

24. The home appliance or the vacuum wall according to claim 20, wherein the reinforcing member is arraigned in conformity with a shape of a front edge of the inner case.

25. The home appliance or the vacuum wall according to claim 20, wherein the reinforcing member is arranged near a front edge of the inner case.

26. The home appliance or the vacuum wall according to claim 20, wherein the reinforcing member extends from a first edge of the inner case or the outer case to a second edge of the inner case or the outer case.

27. The home appliance or the vacuum wall according to claim 20, wherein the reinforcing member extends from a first edge of the inner case or the outer case to a corner of the inner case or the outer case.

* * * * *